US006942355B1

(12) United States Patent
Castiglia

(10) Patent No.: US 6,942,355 B1
(45) Date of Patent: Sep. 13, 2005

(54) DECORATIVE LIGHTING SYSTEM FOR CHRISTMAS TREES AND OTHER DECORATIVE TREES AND BUSHES

(76) Inventor: Helen Castiglia, 7 Linden La., Shirley, NY (US) 11967

( * ) Notice: Subject to any disclaimer, the term of this patent is extended or adjusted under 35 U.S.C. 154(b) by 69 days.

(21) Appl. No.: 10/625,236

(22) Filed: Jul. 22, 2003

(51) Int. Cl.[7] ..... F21S 6/00
(52) U.S. Cl. ..... 362/123; 362/653; 362/654; 362/659; 362/647; 362/806; 428/19; 428/20
(58) Field of Search ..... 362/122, 123, 362/226, 252, 806; 428/18–20

(56) References Cited

U.S. PATENT DOCUMENTS 3,970,834 A * 7/1976 Smith ..... 362/123
4,573,108 A 2/1986 Castiglia et al.

* cited by examiner

*Primary Examiner*—Stephen F Husar
(74) *Attorney, Agent, or Firm*—Bernard S. Hoffman

(57) ABSTRACT

A lighting system has a base and at least one vertical support (trunk) that frictionally engages the base. The vertical support (trunk) has apertures around its circumference and its inner circumference is lined with longitudinal current carrying conductors. A low voltage transformer disposed within the base and electrically connected to a voltage supply contact in the base. The longitudinal current carrying conductors engage the voltage supply contact when the vertical support frictionally engages the base. Pairs of current carrying rods (branches) frictionally engage the vertical support (trunk) at the apertures and have voltage supply contacts that contact the longitudinal current carrying conductors. Ornaments having resilient clasps, with a pair of separately disposed electrical contacts on both sides of the clasp, frictionally engage the current carrying rods (branches) and electrically connect the current carrying rods to the electrical contacts and the ornament.

20 Claims, 3 Drawing Sheets

DECORATIVE LIGHTING SYSTEM FOR CHRISTMAS TREES AND OTHER DECORATIVE TREES AND BUSHES

BACKGROUND OF THE INVENTION

The invention relates to a decorative lighting system and in particular, to an apparatus for mounting removable low voltage incandescent lights with spring holding clamps randomly throughout a decorative lighting system, such as an artificial Christmas tree.

U.S. Pat. No. 4,573,108 discloses a decorative lighting system. This system has individual low voltage incandescent lights mountable upon removable limbs which are interconnected with stems or base supports. The stem or base support comprises a material of a low voltage high density conductive plastic, or a laminated metallic conductor. The branch is made of a material that acts as a low voltage conductor.

This system has several disadvantages including that the overall height of the system cannot be adjusted. Further, the system is simply constructed of a material that allows for the passage of a safe voltage of electricity and the ornaments are attached directly to this material without any insulation. Additionally, the transformer is not incorporated into the system. Finally, the placement of the ornaments is limited since they cannot be placed near artificial needles on the tree. The present application improves upon the disadvantages of this patent.

SUMMARY OF THE INVENTION

The invention provides a decorative lighting system having individual low voltage incandescent lights mountable upon removable limbs or pairs of current carrying rods which are interconnected with trunks or vertical supporting members. The light bulbs may be placed randomly at any position throughout the decorative lighting system since they are clamped to pairs of current carrying rods of the decorative lighting system.

The lighting system has a base and at least one vertical support (trunk) that frictionally engages the base. The vertical support (trunk) has apertures around its circumference. Its inner circumference is lined with longitudinal current carrying conductors. A low voltage transformer disposed within the base is electrically connected to a voltage supply contact in the base. The longitudinal current carrying conductors engage the voltage supply contact when the vertical support frictionally engages the base.

Pairs of current carrying rods (branches) frictionally engage the vertical support (trunk) at the apertures and have voltage supply contacts that contact the longitudinal current carrying conductors.

Ornaments and lamps having resilient clasps, with a pair of separately disposed electrical contacts on both sides of the clasp, frictionally engage the current carrying rods (branches) and electrically connect the current carrying rods to the electrical contacts and the ornament. This allows the user to creatively decorate a Christmas tree without being limited to specific locations for Christmas tree lights or by the use of cumbersome and unsightly Christmas tree lighting.

BRIEF DESCRIPTION OF THE DRAWINGS

Other objects and features of the present invention will become apparent from the following detailed description considered in connection with the accompanying drawings.

It is to be understood, however, that the drawings are designed as an illustration only and not as a definition of the limits of the invention.

In the drawings, wherein similar reference characters denote similar elements throughout the several views:

FIG. 1 shows an elevation view of a vertical support and base of the system;

FIG. 2 shows a top view of a pair of current carrying rods entering the vertical support along line I—I of FIG. 1;

FIG. 3 shows a side view of the pair of current carrying rods;

FIG. 4 shows a cross section of the pair of current carrying rods along line III—III of FIG. 3;

FIG. 5 shows an elevation view of an ornament for mounting on the pair of current carrying rods; and FIG. 6 shows an elevation view of the ornament mounted on the pair of current carrying rods.

DETAILED DESCRIPTION OF THE PREFERRED EMBODIMENT

Figure 1:
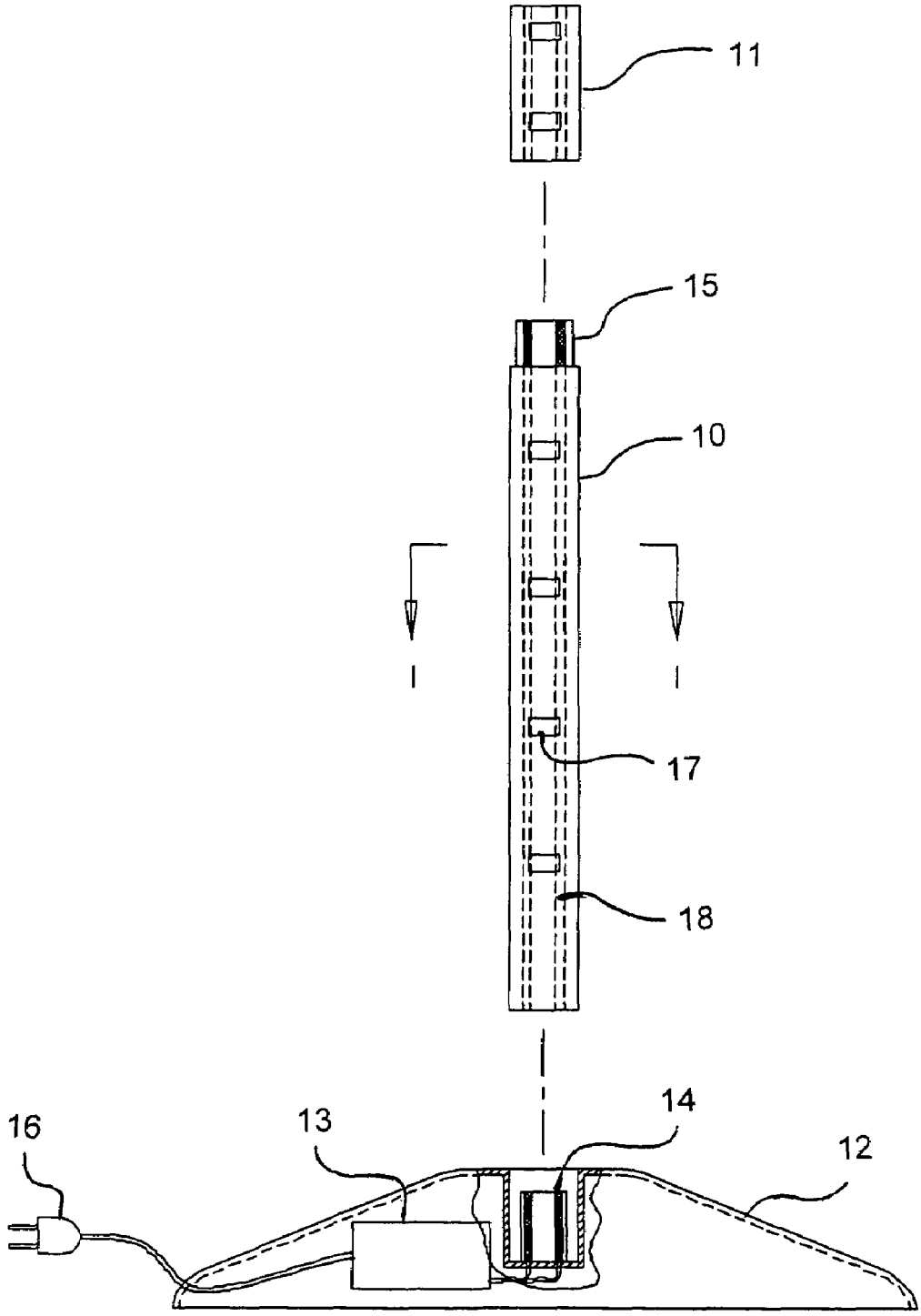

Referring in detail to the drawings, FIG. 1 shows a vertical support 10 and base 12 of the system. Vertical support 10 may be extended to a desired height with the addition of one or more trunk extensions 11. Base 12 includes a low voltage transformer 13 that supplies a current to the system via A/C input 16. Low voltage transformer 13 is connected to voltage supply contact 14 in base 12.

Longitudinal current carrying conductors 18 are disposed along the inner circumference of vertical support 10. Longitudinal current carrying conductors 18 supply electricity from voltage supply contact 14 when vertical support 10 is frictionally engaged with base 12. Longitudinal current carrying conductors 18 are arranged to supply and return power on alternate conductors.

An additional voltage supply may be disposed at the top of vertical support 10 for frictional and electrical engagement with extension 11. The top of the highest extension 11, has an aperture for a plug of a tree top ornament in a preferred embodiment. This aperture is in connection with longitudinal current carrying conductors 18 of highest extension 11.

Figure 2:
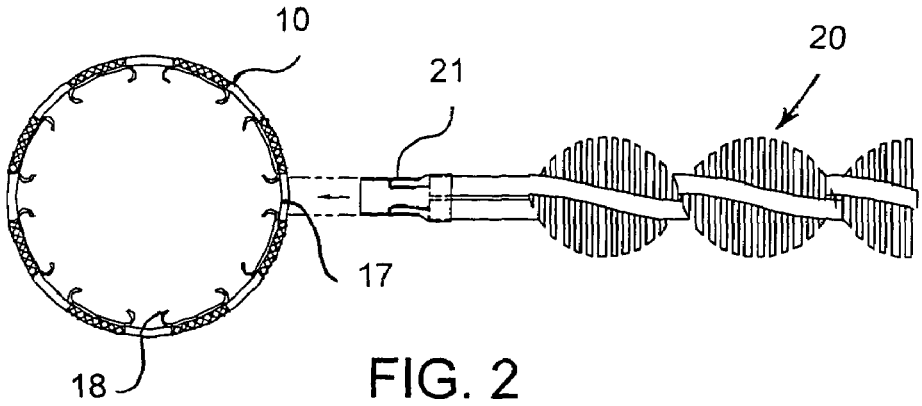

FIG. 2 shows a top view of vertical support 10 and a branch 20. Branch 20 is inserted into apertures 17 in vertical support 10. There, branch 20 frictionally engages longitudinal current carrying conductors 18. An electrical contact 21 is disposed at the end of branch 20 that engages longitudinal current carrying conductors 18. Electrical contact 21 provides mechanical support and is shaped in such a way so as to provide proper orientation of electrical contact 21 to longitudinal current carrying conductors 18 in vertical support 10.

Figure 3:
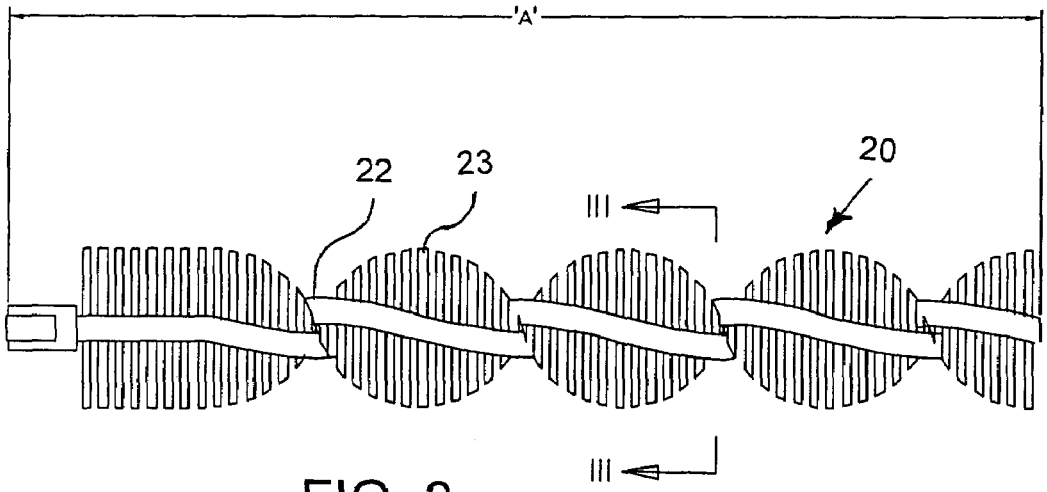
Figure 4:
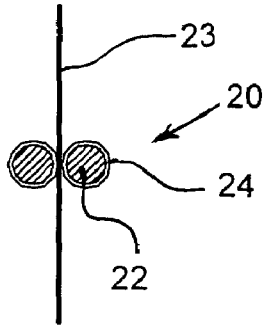

FIG. 3 shows a side view of branch 20. Insulated current carrying rods 22 are twisted with artificial pine needles 23 between them. FIG. 4 shows a cross section of branch 20 showing insulation 24 around current carrying rods 22.

Figure 5:
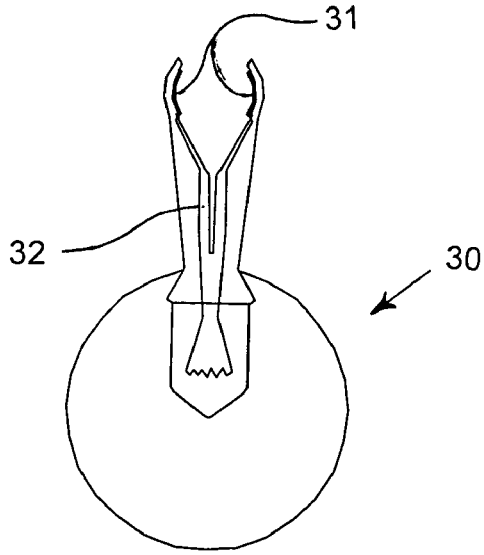
Figure 6:
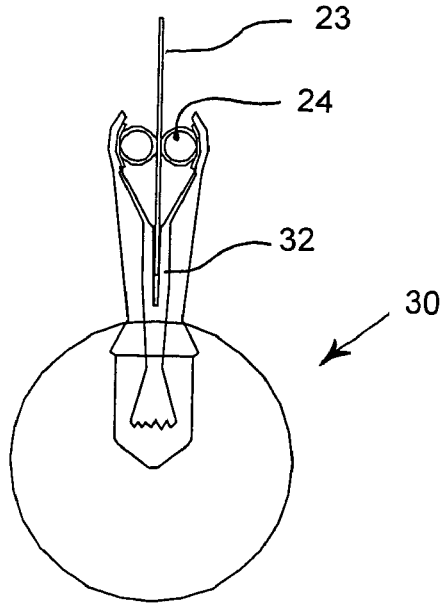

FIG. 5 shows an ornament 30 that engages the system. Ornament 30 has piercing contacts 31 that mount ornament 30 to branch 20 and supply voltage to ornament 30. Leads 32 bring current from branch 20 to ornament 30. FIG. 6 shows ornament 30 engaged on branch 20. Piercing contacts 31 pierce through insulation 24 to reach current carrying rods 22. Pine needles 23 extend between leads 32 of ornament 30 when connected.

In a preferred embodiment base 12 is a tree stand, vertical support 10 is an artificial Christmas tree trunk, and branches 20 are artificial Christmas tree branches.

Accordingly, while one embodiment of the present invention has been shown and described, it is obvious that many changes and modifications may be made thereunto without departing from the spirit and scope of the invention.

What is claimed is:

1. A lighting system for conducting an electrical current, comprising:

a) a base;

b) a voltage supply contact disposed at said base;

c) at least one vertical support engaging said base;

wherein an inner circumference of said at least one vertical support is lined with current carrying conductors that engage said voltage supply contact when said at least one vertical support engages said base; and d) a plurality of current carrying rods engaging said at least one vertical support and having electrical contacts contacting said current carrying conductors so as to provide a current through said current carrying rods for engagement of electrical ornaments.

2. The lighting system according to claim 1, further comprising a plurality of ornaments having resilient clasps, with a pair of separately disposed electrical contacts on both sides of said clasp engaging said current carrying rods and electrically connecting said current carrying rods to said electrical contacts of said ornament.

3. The lighting system according to claim 1, wherein said at least one vertical support has an additional voltage supply contact at a top end thereof that connects to current carrying conductors of additional vertical supports.

4. The lighting system according to claim 1, wherein a top end of a highest said at least one vertical support has an aperture for a plug and which is electrically coupled to said current carrying conductors.

5. The lighting system according to claim 2, wherein said plurality of current carrying rods are each surrounded with insulation.

6. The lighting system according to claim 5, wherein said electrical contacts of said plurality of ornaments pierce said insulation of said plurality of current carrying rods.

7. The lighting system according to claim 2, further comprising artificial pine needles being twisted between said plurality of current carrying rods.

8. The lighting system according to claim 7, wherein at least one of said artificial pine needles projects into an aperture between said electrical contacts of said ornament when said ornament is in connection with said current carrying rods.

9. The lighting system according to claim 1, wherein said base is a tree stand.

10. The lighting system according to claim 1, wherein said at least one vertical support is an artificial tree trunk.

11. The lighting system according to claim 1, wherein said plurality of current carrying rods are artificial tree branches.

12. The lighting system according to claim 1, further comprising a low voltage transformer being disposed within said base and for electrically connecting with an AC power source.

13. The lighting system according to claim 12, wherein said base has at least one aperture.

14. The lighting system according to claim 13, wherein said voltage supply contact is electrically connected to said low voltage transformer and disposed in said at least one aperture of said base.

15. The lighting system according to claim 13, wherein said at least one vertical support frictionally engages said base at said at least one aperture thereof.

16. The lighting system according to claim 1, wherein said current carrying conductors are longitudinal current carrying conductors.

17. The lighting system according to claim 1, wherein said at least one vertical support has a plurality of apertures around its circumference.

18. The lighting system according to claim 17, wherein said plurality of current carrying rods frictionally engage said at least one vertical support at said plurality of apertures thereof.

19. The lighting system according to claim 1, wherein said plurality of current carrying rods are a plurality of pairs of current carrying rods.

20. A lighting system for conducting an electrical current, comprising:

a) a base;

b) a voltage supply contact disposed at said base;

c) at least one vertical support engaging said base;

wherein an inner circumference of said at least one vertical support is lined with current carrying conductors that engage said voltage supply contact when said at least one vertical support engages said base;

d) a plurality of current carrying rods engaging said at least one vertical support and having electrical contacts contacting said current carrying conductors so as to provide a current through said current carrying rods for engagement of electrical ornaments; and e) artificial pine needles being twisted between said plurality of current carrying rods.

* * * * *